US009630236B1

(12) United States Patent
Chang

(10) Patent No.: US 9,630,236 B1
(45) Date of Patent: Apr. 25, 2017

(54) PIPE POSITIONING DEVICE

(71) Applicant: SUN-WONDER INDUSTRIAL CO., LTD., Taoyuan (TW)

(72) Inventor: Chia-Chun Chang, Taoyuan (TW)

(73) Assignee: SUN-WONDER INDUSTRIAL CO., LTD, Taoyuan (TW)

( * ) Notice: Subject to any disclaimer, the term of this patent is extended or adjusted under 35 U.S.C. 154(b) by 0 days.

(21) Appl. No.: 14/995,095

(22) Filed: Jan. 13, 2016

(51) Int. Cl.
*B21D 41/02* (2006.01)
*B21D 43/00* (2006.01)
*B21D 43/26* (2006.01)

(52) U.S. Cl.
CPC ..... *B21D 43/003* (2013.01); *B21D 41/02* (2013.01); *B21D 41/021* (2013.01); *B21D 43/26* (2013.01)

(58) Field of Classification Search
CPC ..... B21D 43/003; B21D 41/02; B21D 43/26; B21D 41/021
USPC ..... 72/419, 317, 370.1, 370.11
See application file for complete search history.

(56) References Cited

U.S. PATENT DOCUMENTS 1,783,639 A * 12/1930 Canny ..... B21D 41/021 72/317
2,769,358 A * 11/1956 Hill ..... B21D 39/06 72/392
3,610,016 A * 10/1971 Bultman ..... B21D 41/00 72/317
8,869,581 B2 * 10/2014 Houle ..... B21D 41/021 72/117

* cited by examiner

*Primary Examiner* — David B Jones

(57) ABSTRACT

A pipe positioning device for pipe expander includes a mold positioning device defining therein a locating space, an axle located at an outer side of the mold positioning device, and a stop member including a barrel pivotally coupled to and movable along the axle, an extension arm extended from the barrel and a stop plate located at the distal end of the extension arm and turnable about the axle into the locating space to abut at a front end of a mold in the locating space for stopping against a pipe in the mold for expanding, facilitating quick pipe expanding.

5 Claims, 5 Drawing Sheets

PIPE POSITIONING DEVICE

BACKGROUND OF THE INVENTION

1. Field of the Invention

The present invention relates to processing blocks, and more particularly to a pipe positioning device for pipe expander, which ensures positive positioning of the pipe to be expanded, facilitating pipe expanding operation and increasing the yield.

2. Description of the Related Art

When connecting two pipes in a line, the conventional method is to expand one end of each pipe using a pipe expander, and then to attach each pipe to a respective one end of a pipe connector, and then to crimp each pipe onto the pipe connector using a pipe crimping device. However, if the pipe protrudes over the front end of the mold in the pipe expander during the expanding operation, the pipe gets no support can be biased and damaged. If the pipe is retracted too far in the mold, the expanded part of the pipe will be insufficient for positively securing to the pipe connector, causing pipe connection problems.

SUMMARY OF THE INVENTION

The present invention has been accomplished under the circumstances in view. It is therefore the main object of the present invention to provide a pipe positioning device for pipe expander, which ensures positive positioning of the pipe to be expanded, facilitating pipe expanding operation and increasing the yield.

To achieve this and other objects of the present invention, a pipe positioning device for pipe expander comprises a mold positioning device, a stop member, an axle and a mold. The mold positioning device comprises a connection member, a first side arm and a second side arm respectively backwardly extended from two opposite lateral sides of the connection member, a stop flange connected between the first side arm and the second side arm remote from the connection member, and a locating space defined therein and surrounded by the connection member, the first side arm, the second side arm and the stop flange for accommodating the mold. The stop member comprises a barrel pivotally coupled to and axially movable along the axle, an extension arm extended from the barrel and a stop plate perpendicularly extended from a distal end of the extension arm remote from the barrel. The axle is mounted at the first side arm to support the barrel of the stop member, allowing the stop plate to be turned about the axle into the locating space and moved into abutment against a front end of the mold for stopping a pipe in the mold for expanding so that the stop pipe can be turned about the axle toward the outside of the locating space during the operation of expanding the pipe.

DETAILED DESCRIPTION OF THE PREFERRED EMBODIMENT

Figure 1:
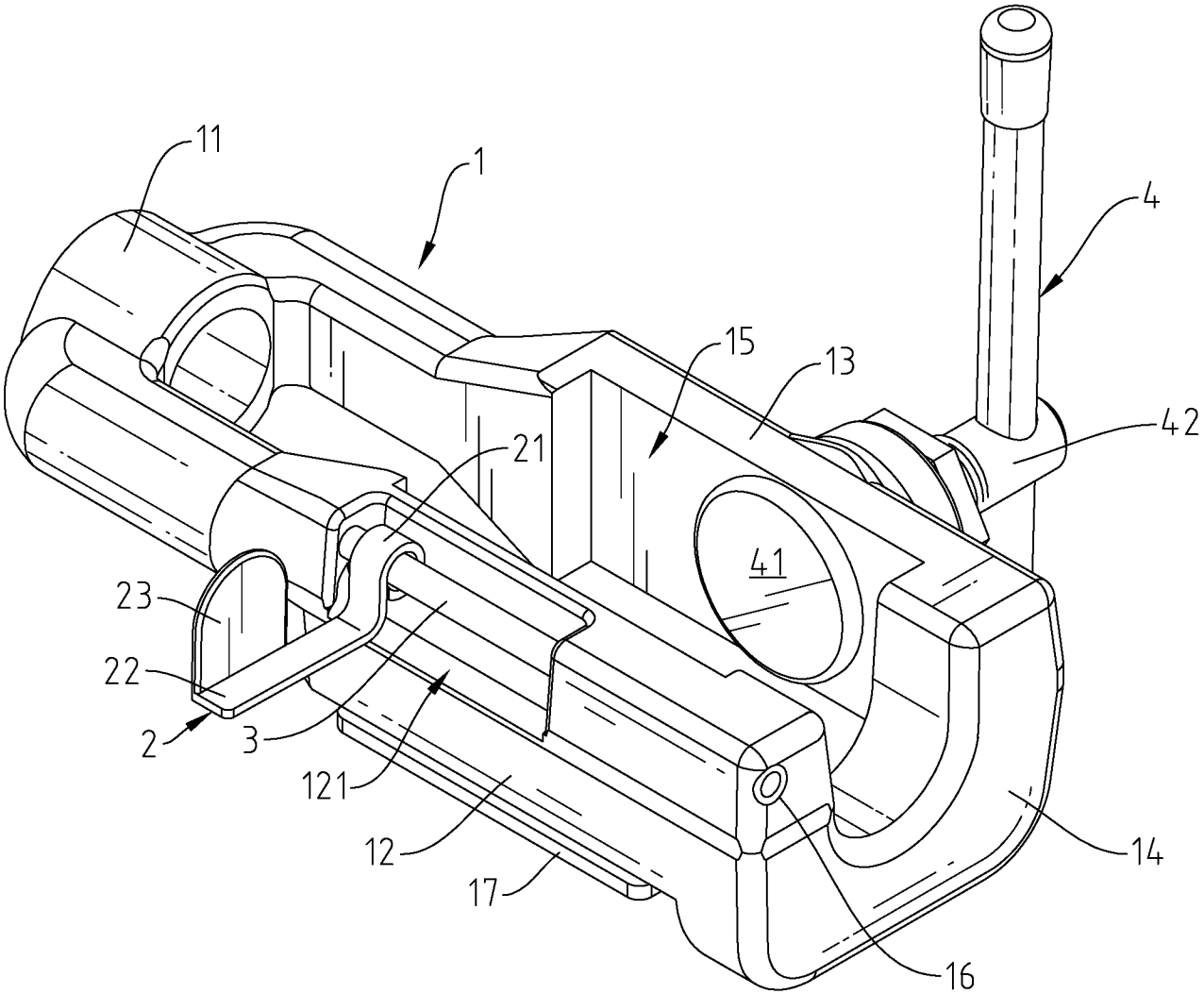
FIG. 1 is an oblique top elevational view of a pipe positioning device in accordance with a first embodiment of the present invention.
Figure 2:
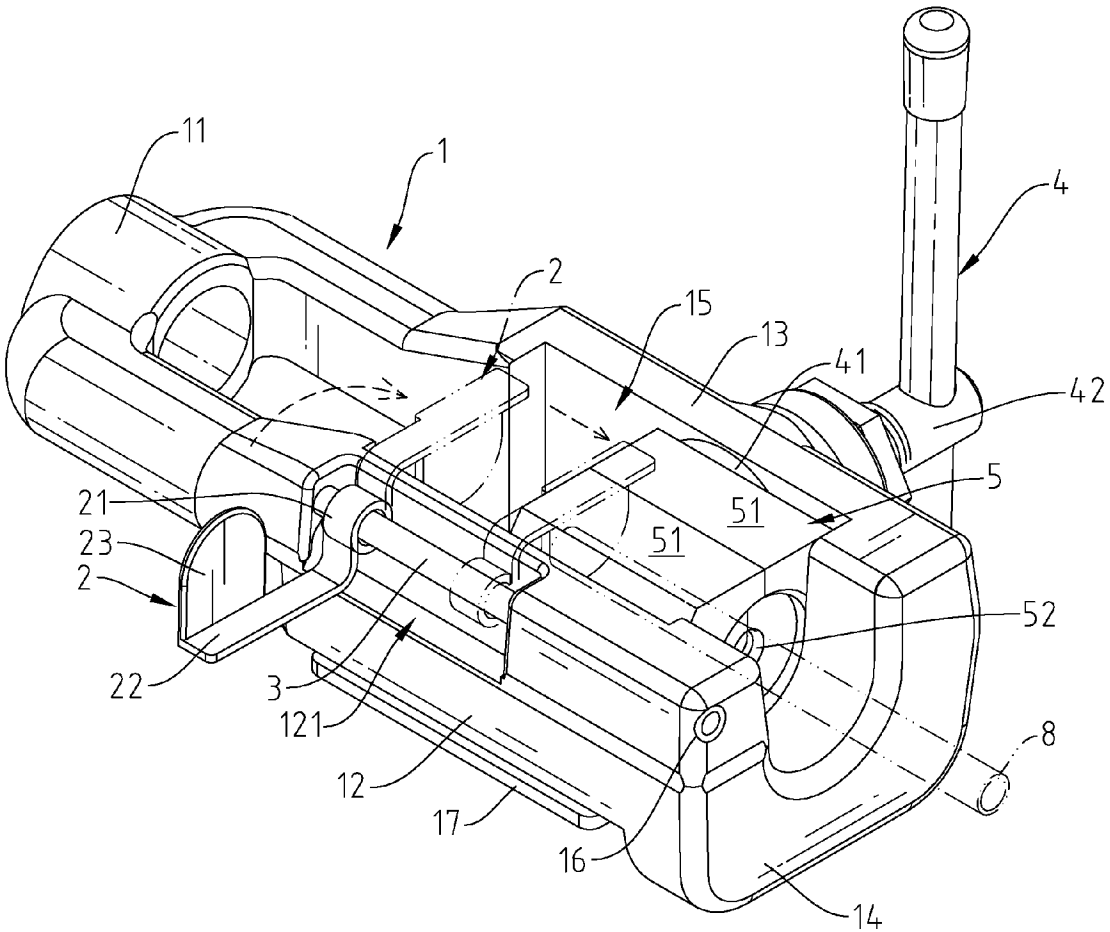
FIG. 2 is a schematic drawing illustrating a status of use of the pipe positioning device in accordance with a first embodiment of the present invention.

Referring to FIGS. 1 and 2, a pipe positioning device for pipe expander in accordance with a first embodiment of the present invention is shown. The pipe positioning device comprises a mold positioning device 1, a stop member 2, an axle 3, a holding down device 4 and a mold 5.

The mold positioning device 1 comprises a connection member 11 located at one end thereof, a first side arm 12 and a second side arm 13 respectively backwardly extended from two opposite lateral sides of the connection member 11, a position-limit member 17 connected between a bottom side of the first side arm 12 and a bottom side of the second side arm 13, a stop flange 14 connected between the first side arm 12 and the second side arm 13 at a rear side remote from the connection member 11, a locating space 15 defined therein and surrounded by the connection member 11, the first side arm 12, the second side arm 13, the position-limit member 17 and the stop flange 14, a recess 121 located at an outer sided of the first side arm 12, and a longitudinal hole 16 longitudinally defined in the first side arm 12 and extended through the stop flange 14 in communication with the recess 121. The axle 3 is inserted into the longitudinal hole 16 with two opposite ends thereof respectively positioned at opposing front and rear sides of the recess 121.

The stop member 2 comprises a barrel 21 coupled to the axle 3, an extension arm 22 extended from one side of the barrel 21, and a stop plate 23 perpendicularly extended from a distal end of the extension arm 22.

The holding down device 4 comprises a pressure plate 41 and a drive lever 42. The pressure plate 41 is disposed in the locating space 15 inside the mold positioning device 1. The drive lever 42 is connected with the pressure plate 41 and thread-connected to the second side arm 13.

The mold 5 consists of two die block 51, and defines therein a chamber 52 that cuts through opposing front and rear ends of the mold 5.

Figure 3:
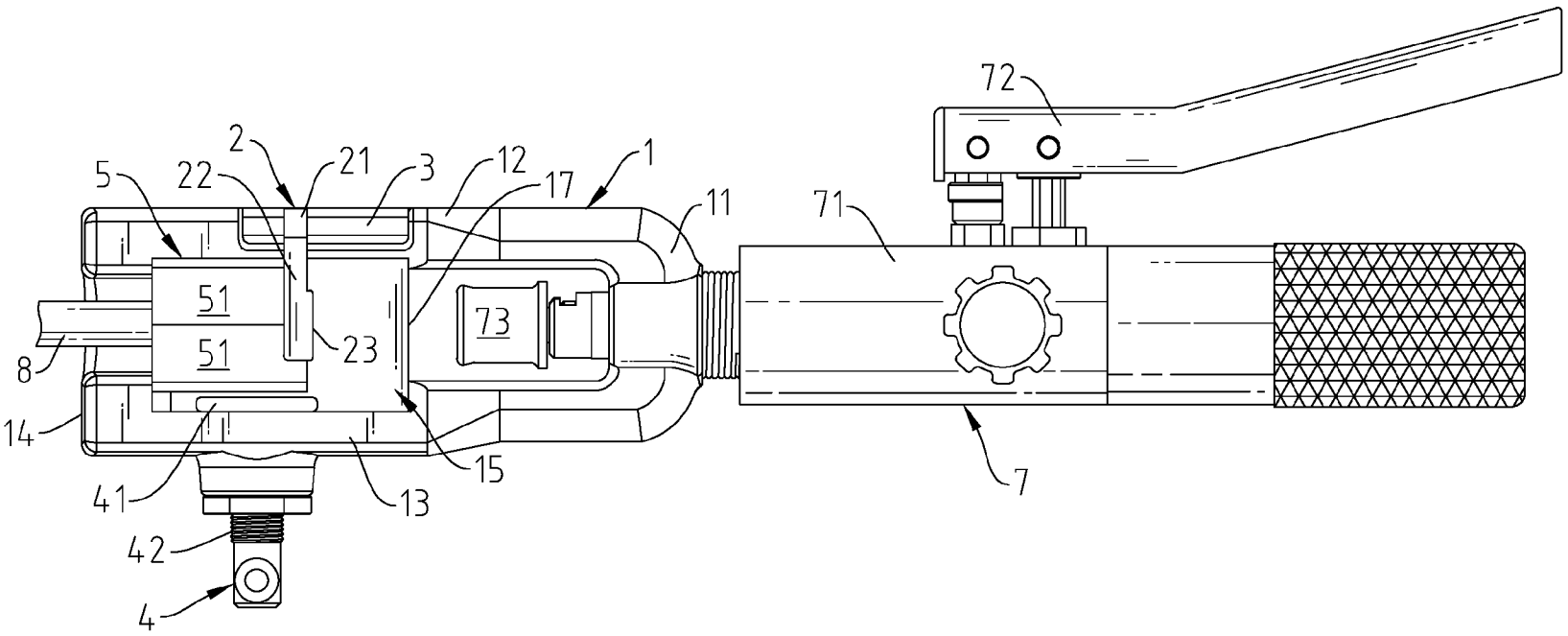
FIG. 3 is a top view of the first embodiment of the present invention, illustrating the pipe positioning device connected to a hydraulic equipment.

Referring to FIG. 3 and FIG. 2 again, as illustrated, when using the pipe positioning device, connect a hydraulic cylinder 71 of a hydraulic equipment 7 to the connection member 11 of the mold positioning device 1 to keep a reciprocating push member 73 of the hydraulic equipment 7 in the locating space 15 of the mold positioning device 1, and then place the mold 5 into the locating space 15, and then insert the pipe 8 to be expanded over the stop flange 14 of the mold positioning device 1 into the chamber 52 in the mold 5. At this time, the user can turn the stop plate 23 about the axle 3 into the inside of the locating space 15 and then move the barrel 21 of the stop member 2 along the axle 3 to have the stop plate 23 be stopped at the front end of the mold 5, and then move the pipe 8 into abutment against the stop plate 23 of the stop member 2, and then operate the drive lever 42 of the holding down device 4 to move the pressure plate 41 toward the mold 5, forcing the two die blocks 51 of the mold 5 clamp on the pipe 8. Thereafter, the user can turn the stop plate 23 of the stop member 2 out of the locating space 15 of the mold positioning device 1, and then operate the operating handle 72 of the hydraulic equipment 7 to move the reciprocating push member 73 in direction away from the hydraulic cylinder 71 toward the stop flange 14 of the mold positioning device 1, forcing the reciprocating push member 73 against the inside wall of the pipe 8 to expand the pipe 8.

Figure 4:
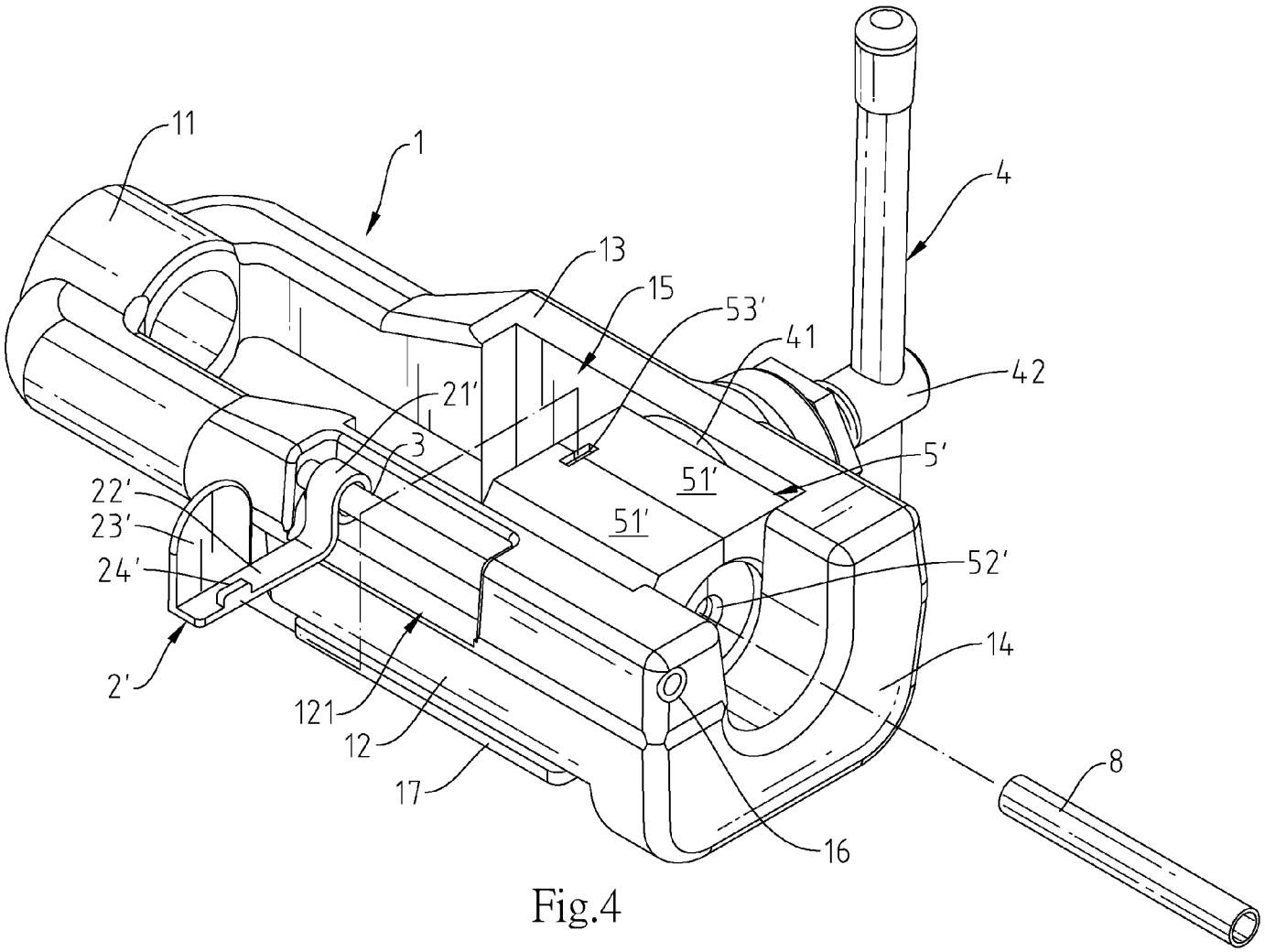
FIG. 4 is an oblique top elevational view of a pipe positioning device in accordance with a second embodiment of the present invention.

Referring to FIG. 4, a pipe positioning device for pipe expander in accordance with a second embodiment of the present invention is shown. This second embodiment is substantially similar to the aforesaid first embodiment with the exception that the stop member 2' further comprises an engagement lug 24' perpendicularly extended from the distal end of the extension arm 22' opposite to the stop plate 23'; the mold 5' comprises a locating groove 53' located on the periphery thereof. When the engagement lug 24' of the stop member 2' is engaged into the locating groove 53', the stop plate 23' is stopped at the front end of the mold 5' to face toward the chamber 52' for stopping against the pipe 8 to be expanded.

Figure 5:
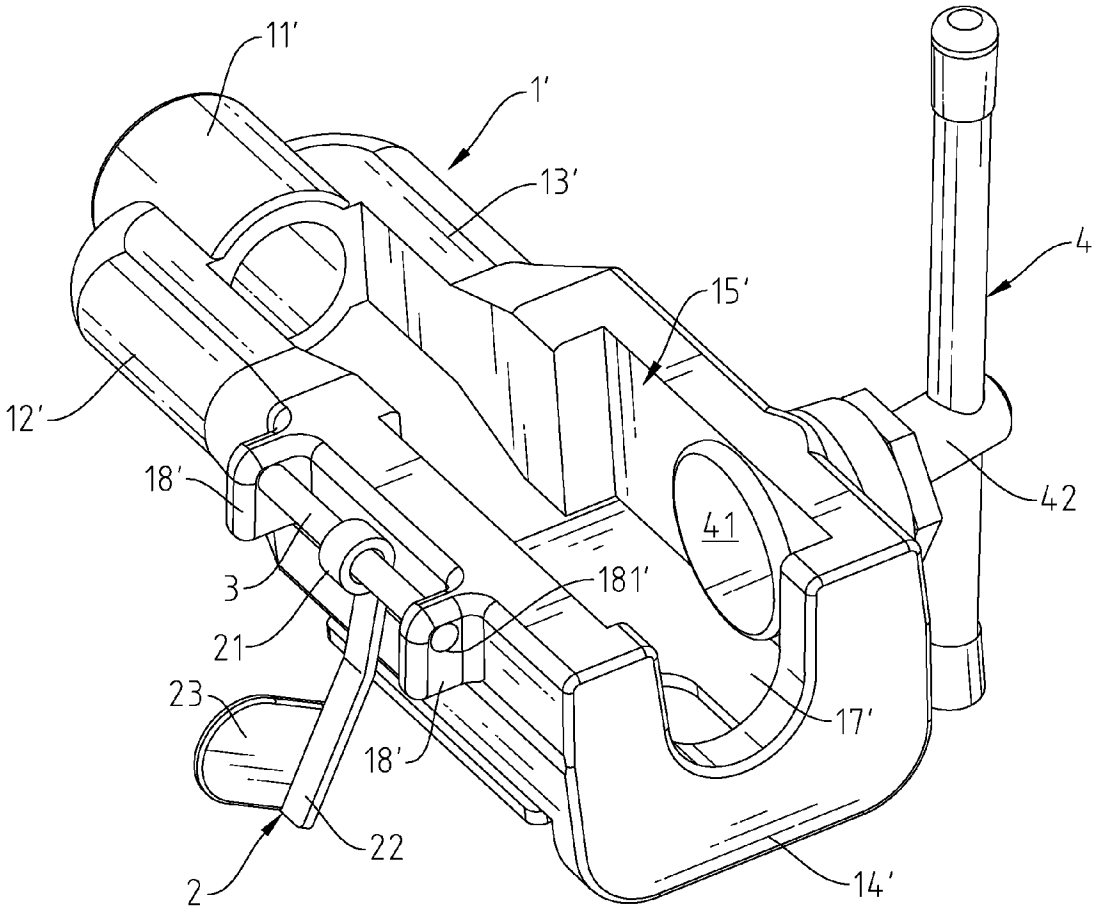
FIG. 5 is an oblique top elevational view of a pipe positioning device in accordance with a third embodiment of the present invention.

Referring to FIG. 5, a pipe positioning device for pipe expander in accordance with a third embodiment of the present invention is shown. This third embodiment is substantially similar to the aforesaid first embodiment with the exception that the mold positioning device 1' comprises two axle supporting portions 18' located at an outer side of the first side arm 12' and spaced from each other at a distance, and a locating hole 181' defined in each axle supporting portion 18'; the axle 3 has two opposite ends thereof respectively fastened to the locating holes 181' at the axle supporting portions 18'.

What is claimed is:

1. A pipe positioning device for a pipe expander, comprising:

a mold positioning device, comprising:

a connection member, a first side arm and a second side arm, the first and second side arms each backwardly extending from respective two opposite lateral sides of said connection member, a stop flange connected between said first side arm and said second side arm remote from said connection member, and a locating space defined in the mold positioning device and surrounded by said connection member, said first side arm, said second side arm and said stop flange for accommodating a mold;

a stop member; and an axle;

wherein:

said stop member comprises a barrel pivotally coupled to and axially movable along said axle, an extension arm extending from said barrel and a stop plate perpendicularly extending from a distal end of said extension arm remote from said barrel; and said axle is mounted on said first side arm to support said barrel of said stop member, allowing said stop plate to be turned about said axle into said locating space and moved into abutment against a front end of said mold for stopping a pipe disposed in said mold so that said stop plate is turnable about said axle toward the outside of said locating space during an operation of expanding said pipe.

2. The pipe positioning device as claimed in claim 1, further comprising a holding down device mounted on said second side arm of said mold positioning device, said holding down device comprising a pressure plate disposed in said locating space inside said mold positioning device and a drive lever threadedly connected to said second side arm and operable to move said pressure plate toward said mold that is positioned in said locating space.

3. The pipe positioning device as claimed in claim 1, wherein said mold positioning device further comprises a recess located at an outer side of said first side arm, and said axle has two opposite ends thereof respectively positioned in opposing front and rear sides of said recess.

4. The pipe positioning device as claimed in claim 1, wherein said mold comprises two die blocks, defining:

a chamber extending through opposing front and rear ends of the mold, and a locating groove located on a periphery of the mold; and said stop member further comprises an engagement lug perpendicularly extending from the distal end of said extension arm opposite to said stop plate and engageable into said locating groove to hold said stop member in a position where said stop plate abuts against the front end of said mold to face toward said chamber.

5. The pipe positioning device as claimed in claim 1, wherein said mold positioning device further comprises two axle supporting portions located at an outer side of said first side arm and a locating hole located at each said axle supporting portion, and said axle has two opposite ends thereof respectively fastened to said locating holes at said axle supporting portions.

* * * * *